US007591688B2

(12) United States Patent
Wang

(10) Patent No.: US 7,591,688 B2
(45) Date of Patent: Sep. 22, 2009

(54) ELECTRICAL CONNECTOR WITH ANTI-MISMATING DEVICE FOR PREVENTING INCORRECT INSERTION OF A SMALLER SIZED MATING CONNECTOR

(75) Inventor: Ning Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,136

(22) Filed: Jun. 16, 2008

(65) Prior Publication Data

US 2008/0311798 A1 Dec. 18, 2008

(30) Foreign Application Priority Data

Jun. 15, 2007 (CN) ..... 2007 1 0023281

(51) Int. Cl.
*H01R 13/64* (2006.01)

(52) U.S. Cl. ..... 439/676; 439/680

(58) Field of Classification Search ..... 439/676, 439/680

See application file for complete search history.

(56) References Cited

U.S. PATENT DOCUMENTS

| | | | | |
|---|---|---|---|---|
| 6,368,160 | B2 * | 4/2002 | Chang | 439/676 |
| 6,416,364 | B1 | 7/2002 | Shi et al. | |
| 6,579,128 | B1 * | 6/2003 | Wu | 439/676 |

FOREIGN PATENT DOCUMENTS

| | | |
|---|---|---|
| CN | 2842797 Y | 11/2006 |
| TW | 1230448 | 4/2005 |
| TW | 1253795 | 4/2006 |
| TW | M296516 | 8/2006 |

* cited by examiner

*Primary Examiner*—Briggitte R Hammond
(74) *Attorney, Agent, or Firm*—Wei Te Chung

(57) ABSTRACT

An electrical connector comprises an insulating housing (1) defining a receiving cavity opening (101) through a front face thereof for receiving a mating connector, a plurality of conductive terminals (2) comprising an elastic contacting portion (22) slantwise extending into the receiving cavity and a discrete limiting member (4) being inserted into the cavity through a inserting opening (15) and positioned under the contacting portion so as to prevent the contacting portions from over moving when an un-mating connector is inserted into the receiving cavity.

18 Claims, 8 Drawing Sheets

ELECTRICAL CONNECTOR WITH ANTI-MISMATING DEVICE FOR PREVENTING INCORRECT INSERTION OF A SMALLER SIZED MATING CONNECTOR

BACKGROUND OF THE INVENTION

1. Field of the Invention

The present invention relates to an electrical connector, more particularly to a modular jack preventing from insertion of an un-mating connector, such as a smaller mating connector.

2. Description of the Related Art

An anti-mismating device is commonly used in a receptacle connector, such as RJ-45, to prevent an insertion of a smaller side plug connector, such as RJ-11. A type of an anti-mismating device is disclosed in Chinese Patent Issued No. 2842797Y issued to ALLTOP TECHNOLOGY CO., LTD., which is formed by a sheet of metal and includes an arc guiding portion and a stopping portion. The stopping portion is urged to lift up to allow a complete insertion of the RJ-45 plug by the guiding portion when the RJ-45 plug is inserted into the RJ-45 receptacle and urge the guiding portion, but not lift up and stop the RJ-11 plug's complete insertion when the RJ-11 plug is inserted into the RJ-45 receptacle since the RJ-11 plug is smaller than the RJ-45 receptacle so as to not urge the guiding portion. The metal device is assembled in the housing.

Another type of an anti-mismating device is disclosed in Taiwan Patent Issued No. I253795 issued to ALLTOP TECHNOLOGY CO., LTD., which use the terminals to function as the anti-mismating device. The front portion of the upwardly slantwise contacting portion of the conductive terminal extends downwards and bents inwards. As a result, the front portion will abut against the inside bottom of the housing when the RJ-11 plug is inserted into the RJ-45 receptacle, the user feel and stop the insertion in time so as to the conductive terminals don't distort. The terminals sometimes still have the damage of distortion.

Third type of an anti-mismating device is disclosed in U.S. Pat. No. 6,416,364 issued to Hon Hai, a same assignee of the invention, which use the terminal module to function as an anti-mismating device. The terminal module includes a plurality of upward ribs aligned with the contacting portions of the terminals. The ribs will prevent the contacting portion from over shift downwards when the RJ-11 plug is inserted the RJ-45 receptacle. The type is complicated and not widely used in other type module jacks, especial to other type of the terminals.

Hence, a new design which can prevent incorrect insertion of a smaller sized mating connector is required.

SUMMARY OF THE INVENTION

Accordingly, an object of the present invention is to provide an electrical connector with simple anti-mismating mechanism for preventing an improper insertion of an undersized mating connector.

In order to achieve the object set forth, an electrical connector comprises an insulating housing defining a receiving cavity opening through a front face thereof for receiving a mating connector, a plurality of conductive terminals comprising an elastic contacting portion slantwise extending into the receiving cavity and a discrete limiting member being inserted into the cavity through a inserting opening and positioned under the contacting portion so as to prevent the contacting portions from over moving when an un-mating connector is inserted into the receiving cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
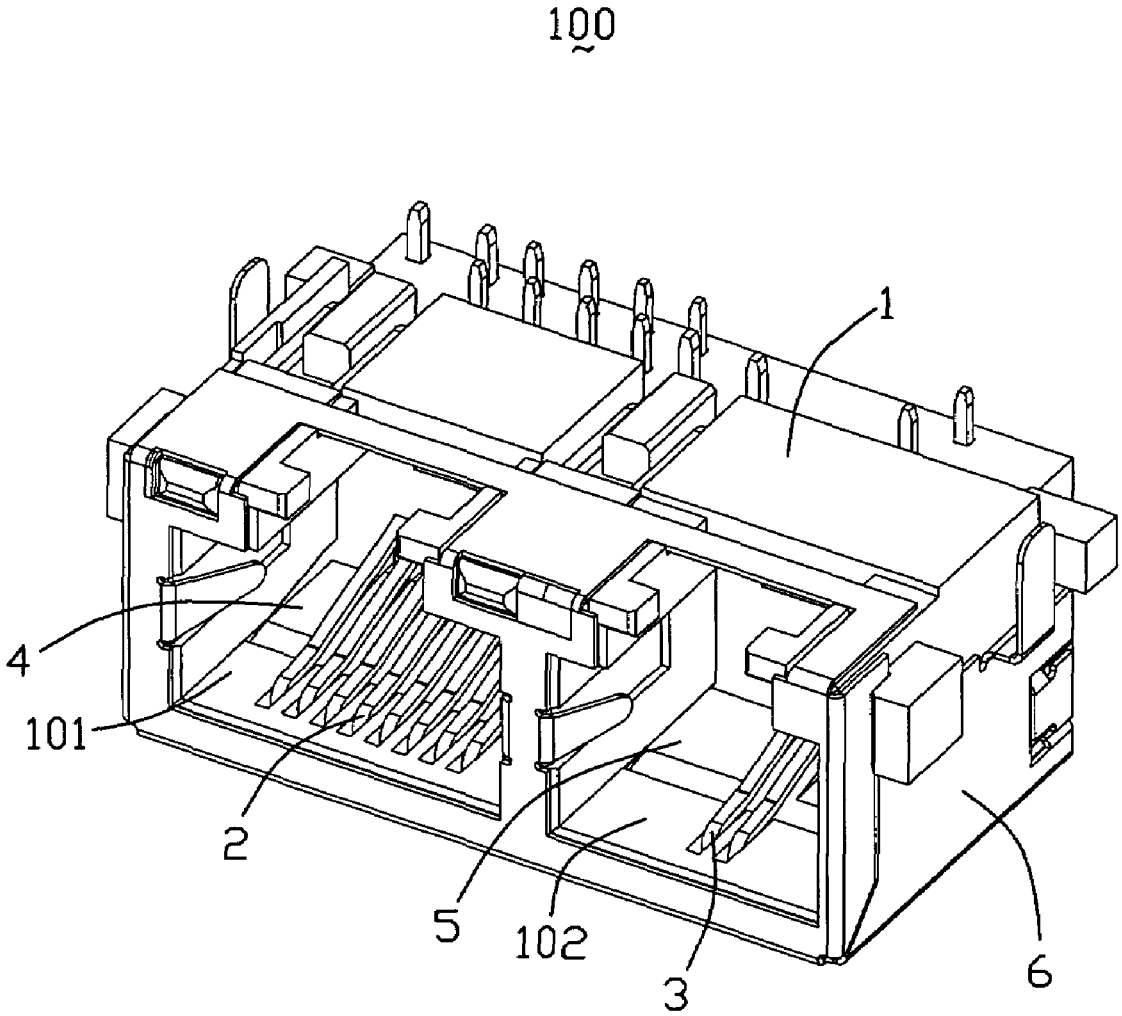
FIG. 1 is a perspective view of an electrical connector in accordance with a first embodiment of the present invention.

Reference will now be made to the drawing figures to describe two embodiments of the present invention in detail.

FIGS. 1 through 4 show a first embodiment and FIGS. 5 through 9 show a second embodiment of the present embodiment. Referring to FIG. 1, an electrical connector 100 of the first embodiment is composed of two connector body to receive different electrical plugs and mainly comprises an insulating housing 1, conductive terminals 2, 3, limiting members 4, 5 and a metallic shell 6.

The insulating housing 1 defines a first and second receiving cavities 101, 102 opening through a front face, i.e. a mating face. Eight first terminals 2 are arranged in the first cavity and two second terminals are in the second cavity. As known, the first cavity 101 is RJ-45 receptacle adapted for a RJ-45 plug while the second cavity 102 is RJ-11 receptacle adapted for a RJ-11 plug, RJ-45 being larger than RJ-11. An anti-mismating device is usually used in the RJ-45 cavity 101 for preventing a smaller sided RJ-11 plug from being inserted thereto, which will be described hereinafter.

Figure 2:
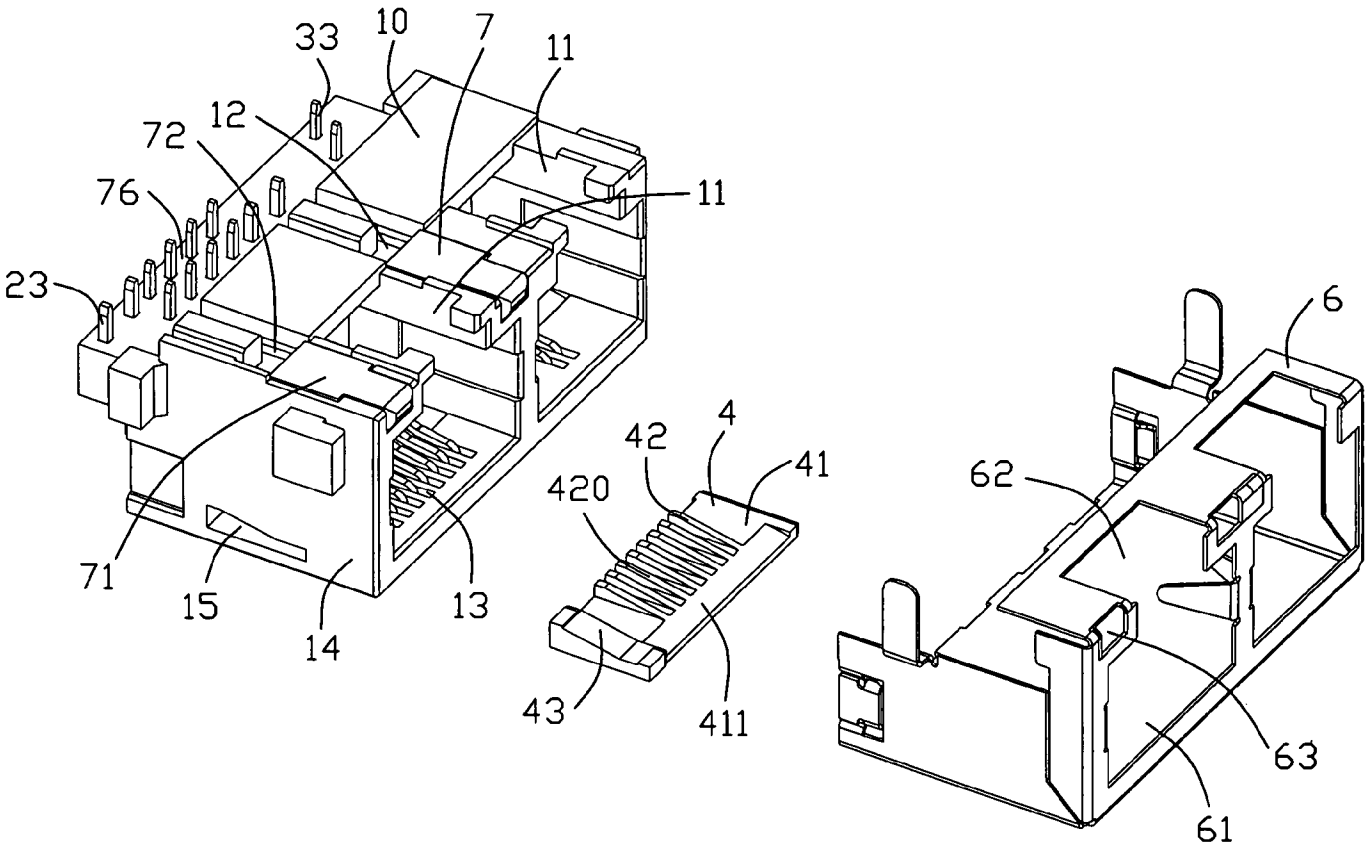
FIG. 2 is an exploded perspective view of the electrical connector shown in FIG. 1.

Referring to FIG. 2, the top of housing 1 opens downward to define a slot 11 corresponding and communicating to each cavity. A pair of lighting devices 7 are mounted in a pair of grooves 12 in a mating direction at sides of the slot 11 wherein the lighting device includes a LED portion 71 and a solder leg 72 extending rearwards and then upward bent. The terminal 2, 3 are retained in passages 13 defined in the inner bottom of the housing and the soldering legs 23, 33 are extending out of the rear wall of the housing and upwards bent to run through corresponding through holes of a space 76 retained on the rear wall of the housing. One outer side wall 14 of the housing defines an inserting opening 15.

The limiting member 4 is made from insulating material and comprises a board-shaped main body 41. Eight ribs 42, side by side and spaced at intervals project upwardly from the main body. Top faces 420 of the ribs slant at a sharp angle to form supporting faces. The front portion 411 of the main body is slant downwards at a same angle as the rib 42 to form a guiding face. A retaining portion 43 is defined at one end of the main body. The limiting member 4 is inserted into the receiving cavity 101 through the inserting hole 15 to function as an anti-mismating device and the retaining portion 43 is fixed in the inserting opening 15. The shell covers the housing and has corresponding openings 61, 62, 63 to the cavities 101, 102, channel 11 and the LED portion.

Figure 3:
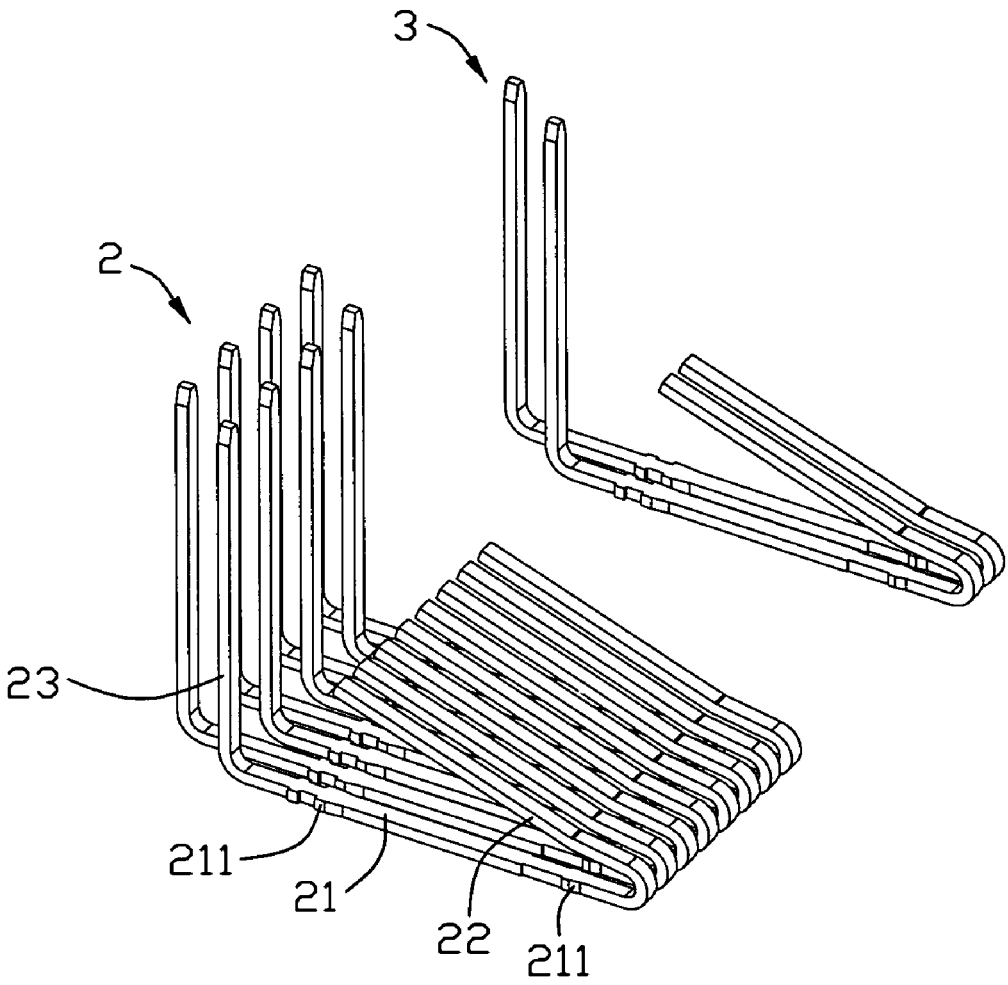
FIG. 3 is a perspective view of the conductive terminals of the electrical connector.
Figure 4:
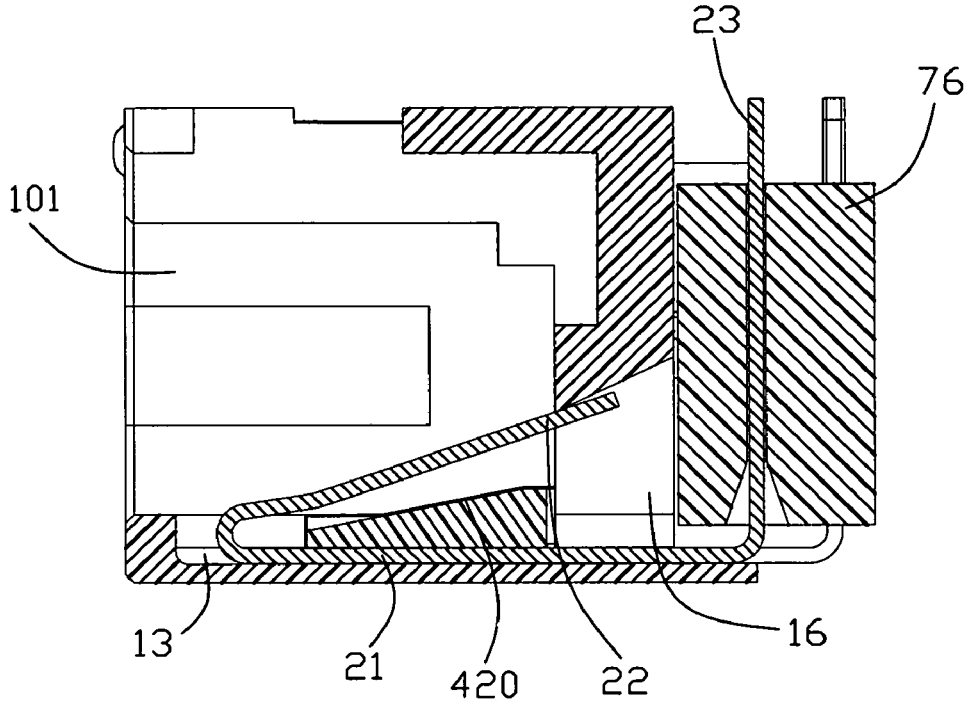
FIG. 4 is a cutaway view of the electrical connector

Referring to FIGS. 3 and 4, each first terminal 2 includes a horizontal fixing portion 21 with fixing projection 211 adjacent to ends thereof, an elastic contacting portion 22 extending rearwards at a sharp angle from a front end of the fixing portion 21 and a soldering portion 23 extending vertically and upwardly from a rear end of the fixing portion 21. The terminals are inserted into the passages 13 through a hole 16 defined in the rear wall of the housing. The contacting portions 22 expose in the cavity 101 with its distal free end abutting against the ceiling of the opening 16. Then the limiting member 4 is inserted under the contacting portion 22 as shown in FIG. 4. The bottom of the limiting member 4 is over the fixing portions 21 of the terminals. The supporting face 420 is just under the contacting portion, which can protect the contacting portion. When a smaller sized plug, such as RJ-11 plug is inserted into the cavity 101, the front housing portion of the plug will press the contacting portion towards the supporting face 420 until abuts against the supporting face, which will be felt by the user. As a result the user knows an occurrence of mis-mating and stop the insertion in time. The contacting portions 22 are still in their spring extend and don't distort. Since the contacting portions 22 are parallel to the supporting face 420 while the contacting portions are against the supporting face, possibility of damage of the contacting portion is less compared with that terminals of which only front point abut against the housing point by point in conventional invention.

The second terminals 3 are similar to the first terminals 2 and a second limiting member 5 is in the second cavity 102. But in other embodiment, there is no limiting member 6 in the second connector body since RJ-11 receptacle can't be inserted by a RJ-45 plug. If the embodiment only has a RJ45 receptacle, the inserting opening 15 may be defined at either side wall of the insulating housing.

Figure 5:
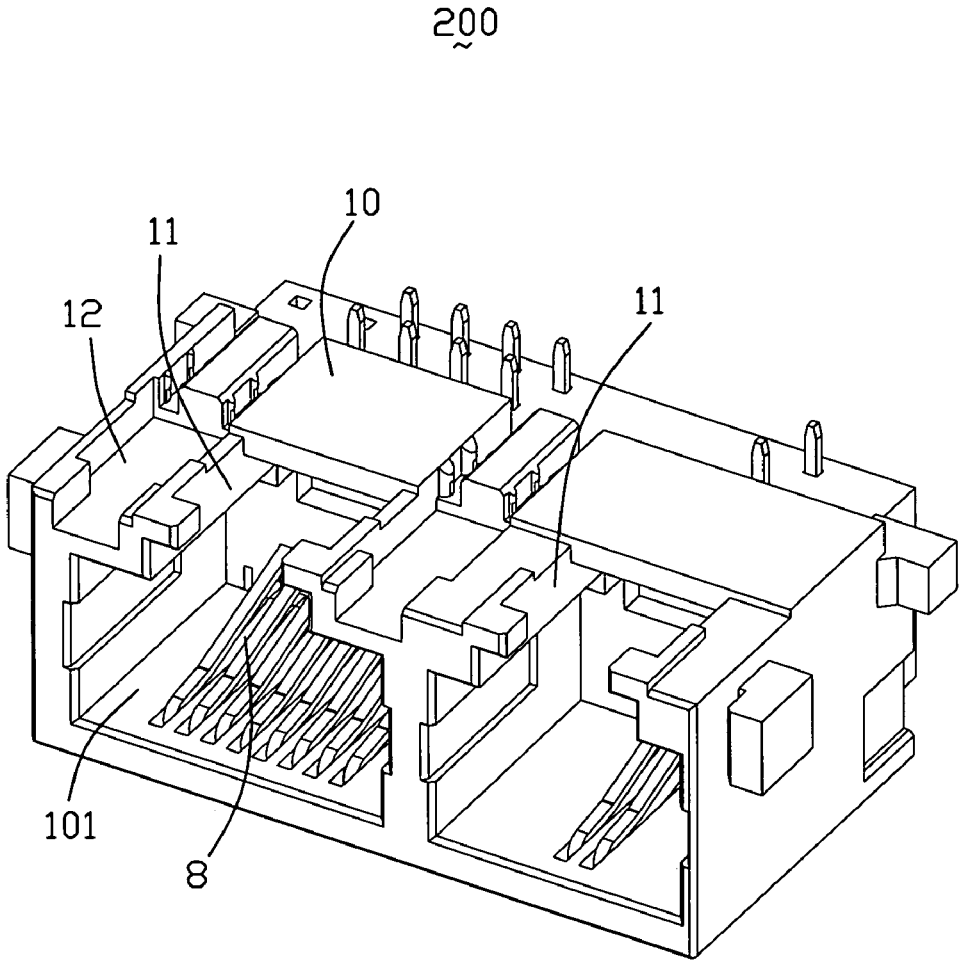
FIG. 5 is a perspective view of an electrical connector without a shell in accordance with a second embodiment of the present invention.
Figure 6:
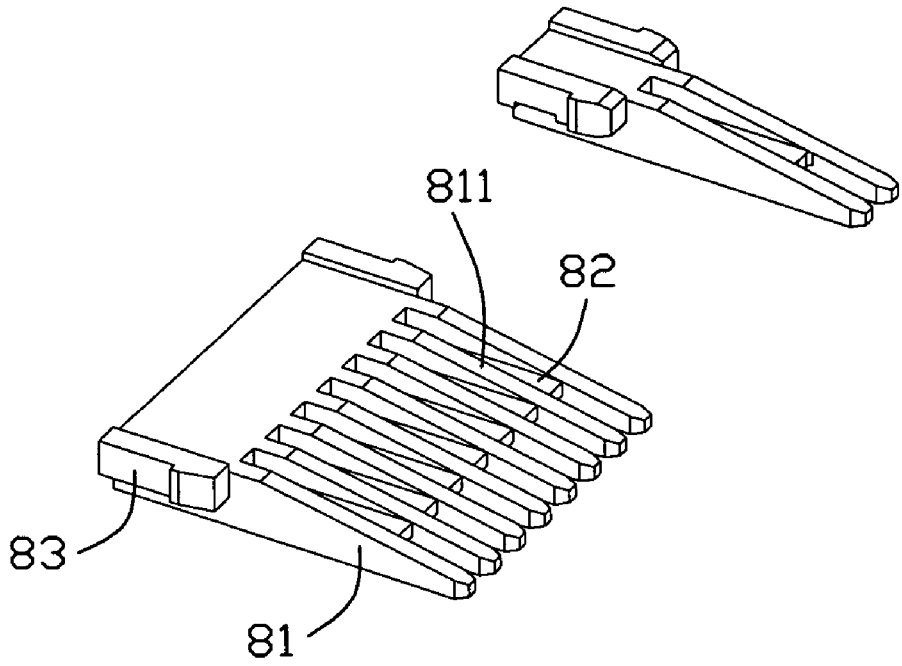
FIG. 6 is a perspective view of the limiting member.
Figure 7:
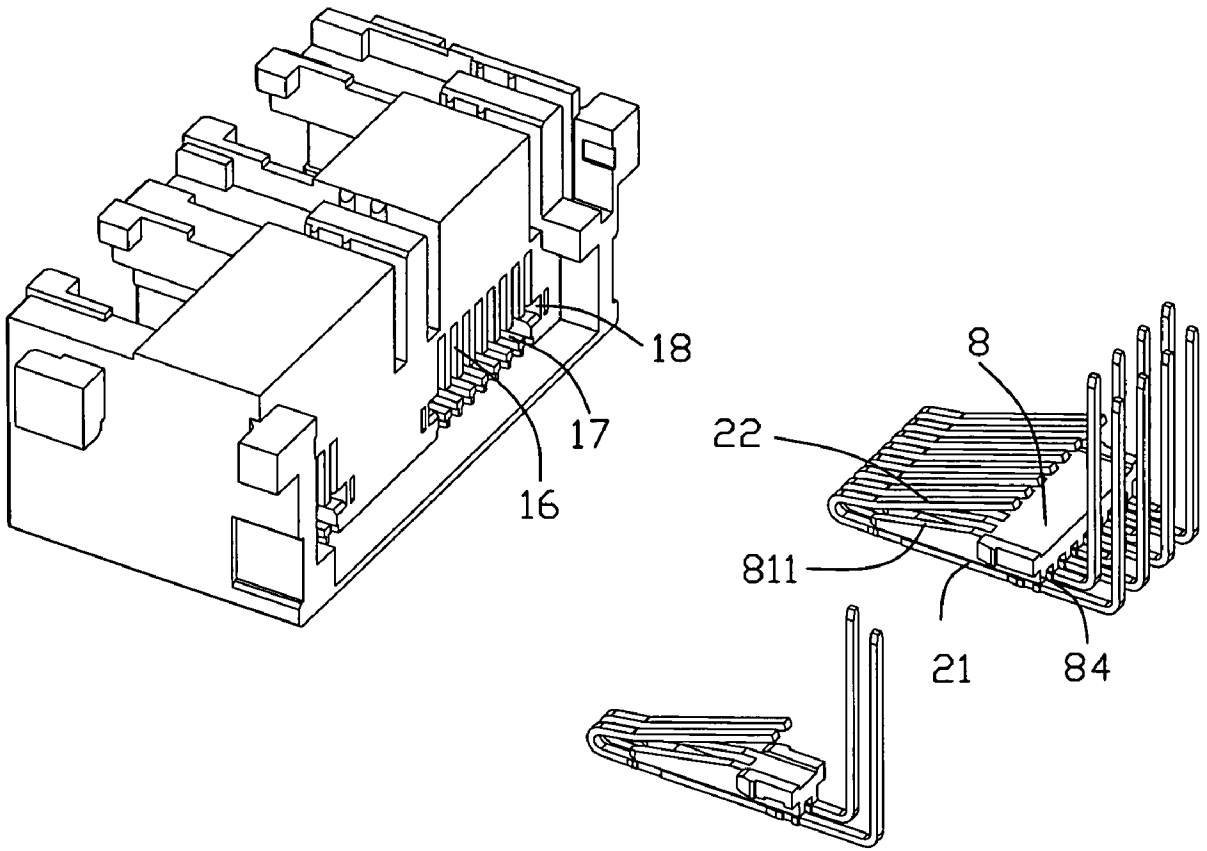
FIG. 7 is an exploded perspective view of the electrical connector.
Figure 8:
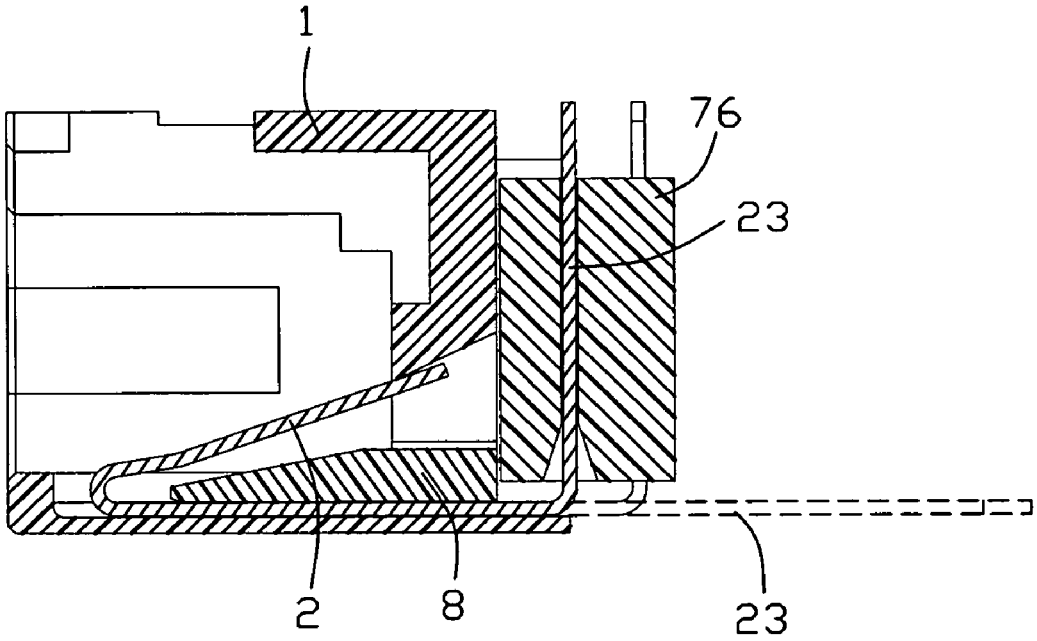
FIG. 8 is a cutaway view of the electrical connector.

Referring to FIG. 5 showing the second embodiment of the invention, a connector 200 is similar to the connector 100 of the first embodiment except the limiting member, wherein the shell and the lighting device is not figured. As FIG. 6 shown, the limiting member 8 is in board shape and has a plurality of rib 81 extending forwards, which form a combo front portion. The combo front portion is slantwise downwards with a sharp angle regard to the bottom thereof. A strengthen portion 82 is integrally formed between every ribs 81 and lower than the supporting face. A pair of retaining portions 83 with rearward hooks are defined at two opposite ends of the rear portion of the limiting member 8. As FIG. 7 shown, the bottom of the limiting member 8 defines a plurality of positioning portion 84 extending downwards and substantially corresponding to the ribs to pressingly position the fixing portions 21 of the terminals. The limiting member 8 is inserted into the cavity through an inserting opening 17 defined at the rear wall of the housing, the inserting opening being through the terminal-inserted opening 16 arranged along a horizontal direction. The retaining portions 18 are retained in the retaining holes 18 at two ends of the inserting opening 17. Referring to FIG. 8, the terminals are inserted into the cavity first wherein the solder legs 23 are not bent as broken lines shown, then the limiting member 8 is inserted between the contacting portion 222 and the fixing portions bent last.

The limiting members 4, 5, 8 are also adapted for terminal module, which can be inserted between the contacting portion and a top of the module. The limiting member is formed separately from the terminals so as to simple manufacture. Moreover, the limiting member can form a standard to widely use, which is most importance to die in cost down and mass product connector's manufactures.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulating housing defining a receiving cavity opening through a front face thereof for receiving a mating connector;

a plurality of conductive terminals comprising an elastic contacting portion slantwise extending into the receiving cavity; and a discrete limiting member being inserted into the cavity through a inserting opening and positioned under the contacting portion in a constantly immoveable manner along a front-to-back direction relative to the housing, so as to prevent the contacting portions from over moving when an un-mating connector is inserted into the receiving cavity; wherein the limiting member comprises a plurality of slant supporting faces thereof, the supporting faces are just below the contacting portions of the conductive terminals; wherein the limiting member comprises a main body and a plurality of spaced ribs extending from the main body respectively vertically aligned with the corresponding contacting portions and respectively forming said supporting faces.

2. The electrical connector as described in claim 1, wherein the ribs extend at a sharp angle.

3. The electrical connector as described in claim 1, wherein the limiting member comprises at least one retaining portion at an end thereof.

4. The electrical connector as described in claim 3, wherein the inserting opening is defined at one side wall of the housing, and a retaining portion is defined at one end of the main body and retained in the inserting opening when the limiting member is inserted into the housing.

5. The electrical connector as described in claim 3, wherein the inserting opening is defined at rear wall of the housing, and a pair of retaining portions are defined at ends of the main body and retained in the rear wall when the limiting member is inserted into the housing.

6. The electrical connector as described in claim 5, wherein a strength portion is integrally formed between every ribs, tops of the strength portions is lower than those of the ribs.

7. The electrical connector as described in claim 5, wherein a plurality of positioning ribs are defined on a bottom of the limiting member to press corresponding fixing portions of the terminals.

8. An electrical connector comprising:

an insulative housing defining a receiving cavity with a front opening extending through a front face of the housing for receiving a mating connector;

a plurality of contacts disposed in the housing, each of said contacts having a contacting section rearwardly extending in a slanted manner, a retaining section joined with a front end of said contacting section and extending rearwardly in a horizontal direction; and a limiting member essentially surrounded by said contacting sections and said retaining sections of said contacts; wherein said limiting member defines a face directing toward the receiving cavity and configured to stop a further movement of the contacting sections of the contacts when an incorrect plug is inserted into the receiving cavity and improperly and excessively presses the contacting sections of the contacts; wherein said limiting member is constantly immoveable with regard to the housing along a front-to-back direction, and defining a plurality of ribs transversely spaced from one another and respectively vertically aligned with the corresponding contacting sections to form corresponding supporting faces thereon.

9. The electrical connector as claimed in claim 8, wherein said limiting element is not integrally formed with the contacts.

10. The electrical connector as claimed in claim 8, wherein said limiting element includes a guiding device so as to guide the limiting element to be assembled to the housing in a horizontal direction forwardly.

11. The electrical connector as claimed in claim 8, wherein said tail sections are equipped with a spacer which is vertically assembled to the housing.

12. The electrical connector as claimed in claim 8, wherein said limiting member is discrete from the housing and assembled thereto.

13. The electrical connector as claimed in claim 8, wherein a tail section extends essentially vertically from a rear end of the retaining section toward a rear end of said contacting section, and said limiting member is surrounded by said contacting sections, said retaining sections and the tail sections of said contacts.

14. The electrical connector as claimed in claim 8, wherein the limiting member defines a plurality of strengthening portions unitarily formed with said ribs alternately at a level lower than said ribs.

15. An electrical connector comprising:

an insulative housing defining a receiving cavity with a front opening extending through a front face of the housing for receiving a mating connector;

a plurality of contacts disposed in the housing, each of said contacts having a contacting section rearwardly extending in a slanted manner, a retaining section joined with a front end of said contacting section and extending rearwardly in a horizontal direction, and a tail section extending from a rear end of the retaining section; and a limiting member essentially surrounded by said contacting sections and said retaining sections of said contacts; wherein said limiting member defines a face directing toward the receiving cavity and configured to stop a further movement of the contacting sections of the contacts when an incorrect plug is inserted into the receiving cavity and improperly and excessively presses the contacting sections of the contacts; wherein the limiting member is constantly immoveable with regard to the housing in a front-to-back direction; wherein said tail sections are equipped with a spacer which is vertically assembled to the housing.

16. The electrical connector as claimed in claim 15, wherein said limiting member defines a plurality of fibs transversely spaced from one another and respectively vertically aligned with the corresponding contacting sections to form corresponding supporting faces thereon.

17. The electrical connector as claimed in claim 15, wherein said limiting member is discrete from the housing and assembled thereto.

18. The electrical connector as claimed in claim 15, wherein said tail section extends essentially vertically from the rear end of the retaining section toward a rear end of said contacting section, and said limiting member is surrounded by said contacting sections, said retaining sections and the tail sections of said contacts.

* * * * *